US006244467B1

(12) United States Patent
Lewit

(10) Patent No.: US 6,244,467 B1
(45) **Date of Patent: *Jun. 12, 2001**

(54) MATERIAL CONTAINER AND DISPENSER HAVING A LITTERLESS CLOSURE

(76) Inventor: Benjamin Lewit, 922 24th St. NW., Apt. 713, Washington, DC (US) 20037

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/122,789

(22) Filed: Jul. 27, 1998

(51) Int. Cl.[7] ..... B65D 35/08
(52) U.S. Cl. ..... 222/107; 222/541.6; 222/543
(58) Field of Search ..... 222/106, 107, 222/105, 92, 541.1, 541.6, 543; 383/200, 207, 208, 209, 906; 206/484

(56) References Cited

U.S. PATENT DOCUMENTS

| | | | | |
|---|---|---|---|---|
| 3,217,971 | | 11/1965 | Shvetz . | |
| 3,874,570 | | 4/1975 | Katzman et al. . | |
| 4,063,638 | | 12/1977 | Marwood . | |
| 4,470,521 | | 9/1984 | Scammell . | |
| 4,805,792 | | 2/1989 | Lecinski, Jr. . | |
| 4,935,283 | * | 6/1990 | Jamison | 428/174 |
| 5,531,358 | * | 7/1996 | Corella | 222/107 |
| 5,746,352 | * | 5/1998 | Corella | 222/107 |

* cited by examiner

*Primary Examiner*—David J. Walczak
*Assistant Examiner*—Peter DeVore
(74) *Attorney, Agent, or Firm*—Shlesinger Arkwright & Garvey, LLP

(57) ABSTRACT

A container and dispenser having a litterless closure comprising a body member having an interior region for containing a material to be dispensed, a frangible portion integral with the body member, the frangible portion adapted to rupturably open a portion of the body member to the interior region and a connector member having first and second portions, the connector member first portion engaged to the body member and engaged at the connector member second portion to the frangible portion whereby the frangible portion remains secured to said body member upon opening of the container.

13 Claims, 4 Drawing Sheets

MATERIAL CONTAINER AND DISPENSER HAVING A LITTERLESS CLOSURE

FIELD OF THE INVENTION

The present invention relates to containers and dispensers, and in particular, single use containers.

BACKGROUND OF THE INVENTION

Many consumer products are packaged to provide single use dispensing of the product. In other words, the package is not adapted to be resealed once it is opened. Applicable products for use in connection with such containers include but are not limited to nutritional foods in the form of high carbohydrate gels for athletes, toothpaste, shampoo, cosmetics and the like.

Typically, a single use container and dispenser is constructed from a laminate comprising two sheets sealed along a perimeter edge to form an interior region containing the product. To dispense the product, an opening is made into the package by sufficiently tearing along an edge of the package. The laminate sheets may be constructed from a material that is easily torn or otherwise adapted to be torn along defined regions of the package. Once opened, the container is squeezed to cause the product to be dispensed.

One problem associated with such containers is litter. That is, because the packages are designed or configured to cause the opening to occur along a desired corner or end region of the package, the corner or end region is often separated from the main package body when opening the package. Since many of the products dispensed from single use containers are consumed by athletes while running, kayaking, cycling or the like, the separated corner or end region is often misplaced or otherwise lost thereby creating a litter problem.

Accordingly, a need has existed in the art for a container and dispenser of the single use type that eliminates the above noted problems associated with the prior art.

OBJECTS AND SUMMARY OF THE INVENTION

It is therefore an object of the present invention to provide a container and dispenser of the single use type that will maintain the package in a single piece following opening of the package.

A still further object of the present invention is to provide a laminate type of packaging provided with a connector that reduces the likelihood of litter while also functioning as a support member for display of the product while on sale.

Another object of the present invention is to provide a new container and dispenser of the single use type that is economically incorporated into the package manufacturing process.

A still further object of the present invention is to provide a laminate type dispenser and container that includes a connector constructed from the same materials as the laminate sheets comprising the package.

A still further object of the present invention is to provide a container and dispenser of the laminate type that is readily adapted into a variety of shapes and designs.

These and other features of the present invention will be apparent from the detailed specification of the preferred embodiments taken together with the drawings and the claims.

In summary the present invention is directed to a container and dispenser having a litterless closure comprising a body member having an interior region for containing a material to be dispensed, a frangible portion integral with the body member, the frangible portion adapted to rupturably open a portion of the body member to the interior region and a connector member having first and second portions, the connector member first portion engaged to the body member and engaged at the connector member second portion to the frangible portion whereby the frangible portion remains secured to said body member upon opening of the container.

The present invention is also directed to a material container and dispenser comprising a body member having at least a front panel and a rear panel, the panels secured therebetween about respective perimeter edges to provide a sealed interior region for containing a material to be dispensed and a connector member having a first end and a second end, the connector member first end engaged to a first region of the body member and engaged at the second end to a second region of the body member whereby upon opening of the body member between the first region and the second region, the regions remain interconnected and liter is reduced.

The present invention is also directed to a material container and dispenser comprising means for containing a material to be dispensed, means for opening said containing means for purposes of dispensing material therein and means for maintaining an interconnection between the containing means and the opening means following opening of the container.

DETAILED DESCRIPTION OF THE PREFERRED EMBODIMENTS

Figure 2:
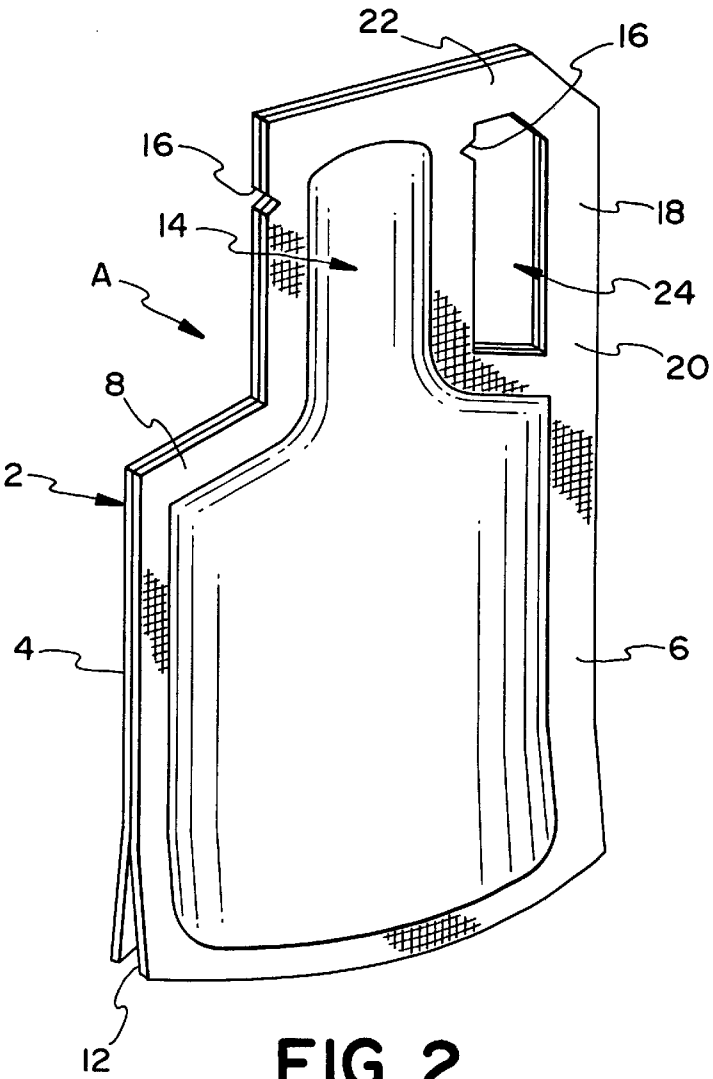
FIG. 2 is a front elevation view of the material container and dispenser shown in FIG. 1.
Figure 1:
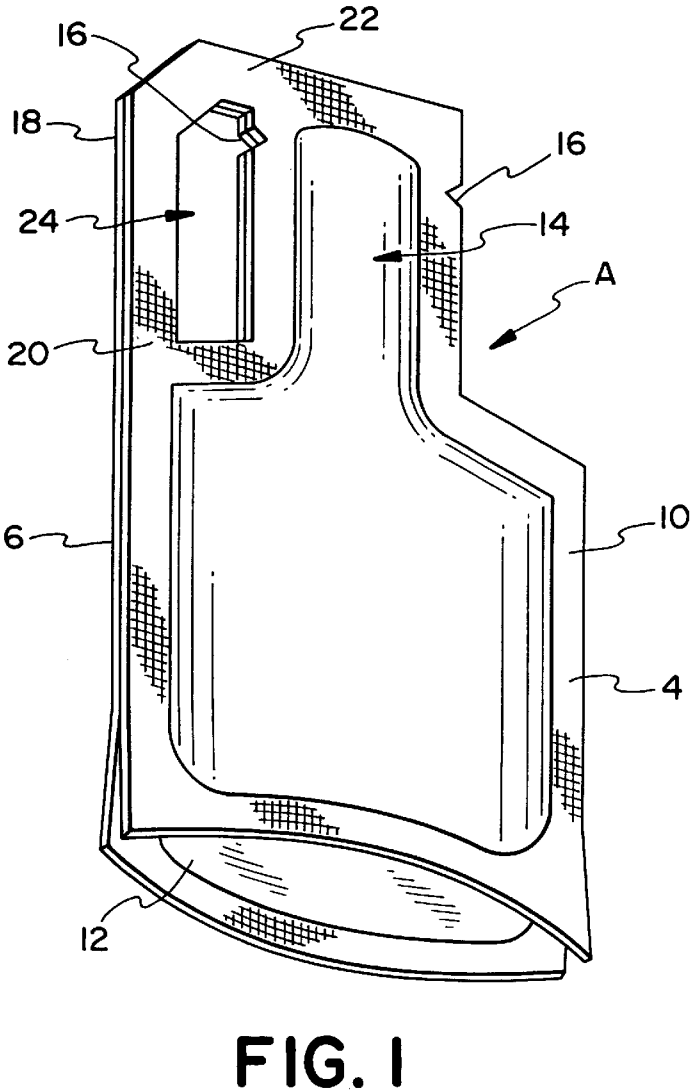
FIG. 1 is a perspective view of the material container and dispenser according to the present invention.
Figure 3:
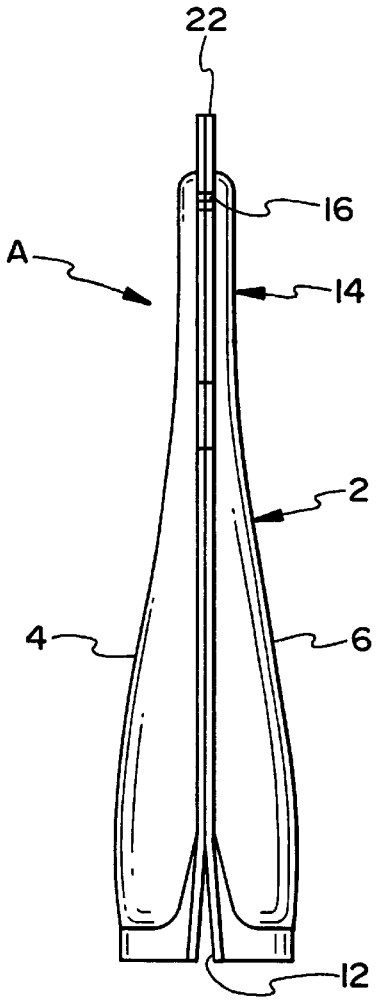
FIG. 3 is a side elevational view of the material container and dispenser shown in FIGS. 1 and 2.

Turning to FIGS. 1 through 3, the container and dispenser A according to the present invention is shown and comprises a main body member 2 shown to have the general outline of a bottle. It is understood the shape of the container according to the present invention is not limited to any particular shape, as will be further explained below, but may be modified depending upon the end use of the container.

The body portion 2 is shown to comprise a front panel 4 and rear panel 6 secured along respective perimeter edges 8 and 10. Container A is shown to include a bottom portion 12 as is known in the art, however the container may be formed without a separate bottom. Generally speaking, the above construction is commonly known as laminated packaging. Other types of non-laminate packaging are within the scope of the present invention provided the container and dispenser is of the single use type. That is, the container is not resealable once it is opened.

The construction materials from which the front panel 4 and rear panel 6 as well as other structure forming the package are made may be selected from any material known in the art with respect to laminate type packaging and the present invention is not limited to any particular type of construction material. In the usual case, the selected material is sufficient to create a secure, leakage-free package for the product yet have a tensile strength such that the package may be readily opened upon grasping of an edge of the container and pulling adjacent edge portions in opposite directions.

As is apparent, the manner in which the opening is made may vary according to the present invention. For example, the opening may be formed along a discrete line of separation disposed on the package during manufacturing. In the typical case, the panel forming the laminate is provided with a rupturable separation line caused by mechanically altering the sheet after forming or when the panel is extruded.

Returning to FIGS. 1 through 3 and as noted earlier, the front panel 4 and the rear panel 6 are joined along respective perimeter edges 8 and 10 to form an interior region (not shown) within the container for holding a material to be dispensed. Body portion 2 is shown to include an end portion 14 having notches 16 extending in the adjacent perimeter edges for purposes of providing a region of the package that may be torn to create an opening.

It is within the scope of the present invention to provide the opening region along any portion of a container. The opening portion as set forth in FIGS. 1 through 3 is provided along end portion 14 for purposes of simulating a conventional bottle.

A connector member 18 is provided and includes a first end 20 shown to be integral with the perimeter edge of body portion 2 and a connector member second end 22 shown to be integral with the edge of end portion 14 and adjacent notches 16. An opening or passageway 24 extends between the connector member 18 and the perimeter edge of the body portion 2.

As is apparent, connector member 18 may be formed into the respective panels during manufacture of container and dispenser and may be formed from the same construction materials as the panels. In the alternative, the connector may be a separate piece secured to or otherwise laminated to the perimeter edges 8 and 10 of the packaging. The connector may be reinforced with fibers or other strengthening material to prevent tearing during opening of the container and dispenser.

Figure 4:
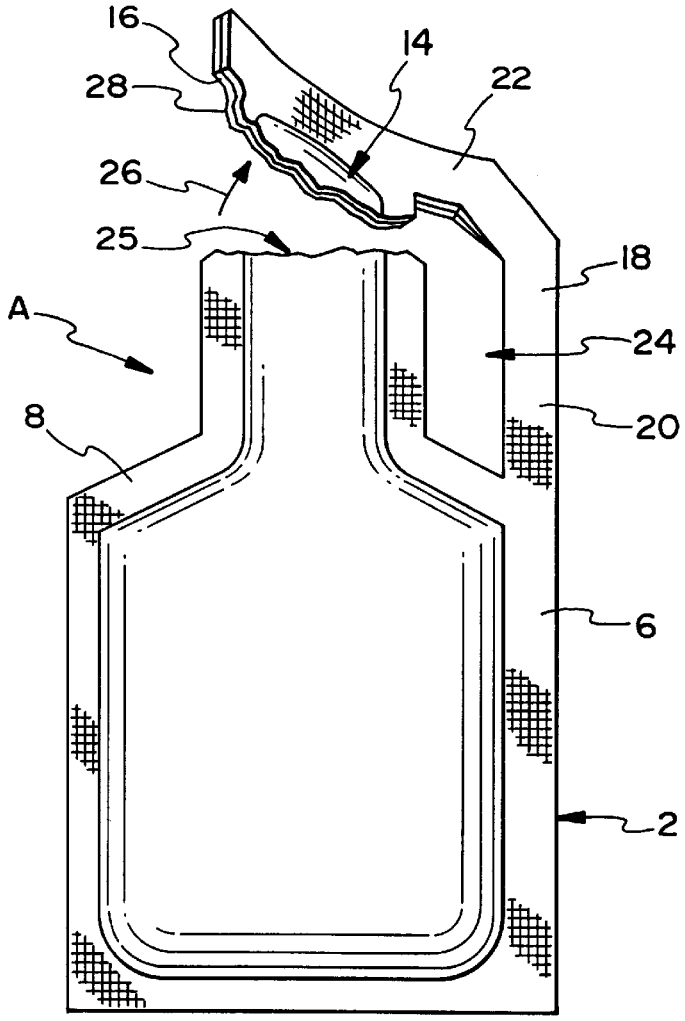
FIG. 4 illustrates the material container and dispenser shown in FIGS. 1–3 upon opening of the container and including an arrow indicating the manner in which and end region of the container removed.

Turning to FIG. 4, the container and dispenser A is shown in an opened position with the end portion 14 remaining attached to the body portion 2. More particularly, the user will cause a tear to occur about notches 16 and across end portion 14 so that an opening 25 is made into container and dispenser A allowing material to be dispensed from the contain and dispenser.

As indicated by arrow 26, a separated portion 28 is lifted apart from end portion 14 and main body portion 2 exposing an opening 25 through which the material is dispensed (not shown). The separated portion 28 remains attached to body portion 2 by connector member 18. In this way, the separated portion may be disposed of with body portion 2 and not cause litter.

As noted above, container A may be adapted for opening many different ways and the present invention is not limited to any specific embodiment. For example, the container and dispenser may be provided with a frangible region having score lines or other rupturable surface features that allow the package to open along a defined region of the package. A reinforced tab may be incorporated into the laminate sheet or otherwise attached which causes a uniform opening to be formed into the package when the tab is pulled along the surface of the package. One of ordinary skill in the art of the packaging industry would readily ascertain the type of opening required for a particular application and modify the container and dispenser accordingly. The present invention is especially adapted for use in association with single use type containers and dispensers whereby a portion of the container or dispenser may be torn off and separated from the main body of the container.

Figure 5:
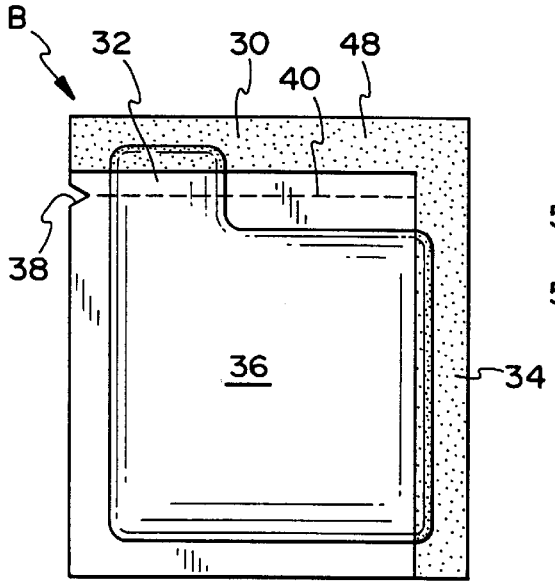
FIG. 5 is a front elevation view of another embodiment of the container an dispenser of the present invention.

Turning to FIG. 5, an alternative embodiment of the present invention is shown. The container and dispenser B includes a connector member 48 extending continuously along a perimeter edge of body portion 36 from a first end 30 adjacent opening region 32 of container B to a second end 34 adjacent perimeter edge of the body portion 36. Connector 48 is shown to include reinforcing material embedded within the material forming the connector strip to enhance the tensile strength of the connector. Accordingly, the connector cannot be torn as the package is opened. A dotted line 40 indicates the region of the package along which a tear is made to open the package and, as noted earlier, the line 40 may comprise score lines or other readily rupturable structure that will permit the package to be opened along a defined region. As is apparent in this embodiment, no separation exists between the connector member 48 and the perimeter edge for any portion of the main body portion of the container B. As noted earlier, the connector member 48 may be constructed from a material that is reinforced or otherwise modified to provide a higher tensile strength than the remaining portions of the container and dispenser to ensure a user does not tear through the connector member during opening of the package.

Figure 6:
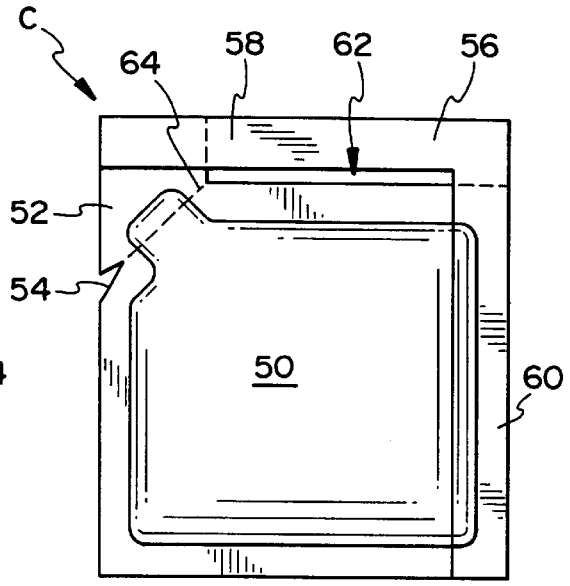
FIG. 6 is a front elevation view of another embodiment of the container and dispenser of the present invention.

Turning to FIG. 6, another embodiment of the present invention is shown whereby a container C is provided having the above noted laminate construction and includes a main body portion 50 having an opening region 52 integral with the main body portion 50 and notch 54 positioned adjacent the opening region for providing a starting point for opening the container as in the previous embodiments. Dotted line 54 indicates the region along which the opening is formed. A connector member 56 is shown having a first end 56 and a second end 58. The first end 58 of connector member 56 is secured to opening region 52 and includes a passageway 62 extending between the connector member 56 and a perimeter edge of the main body portion 50. As is apparent, the user will cause the frangible or rupturable region indicated at line 64 to be torn thereby allowing the material within the container to be dispensed. At the same time, opening region 52 remain attached to the main body portion 50 by the connector 56.

Figure 7:
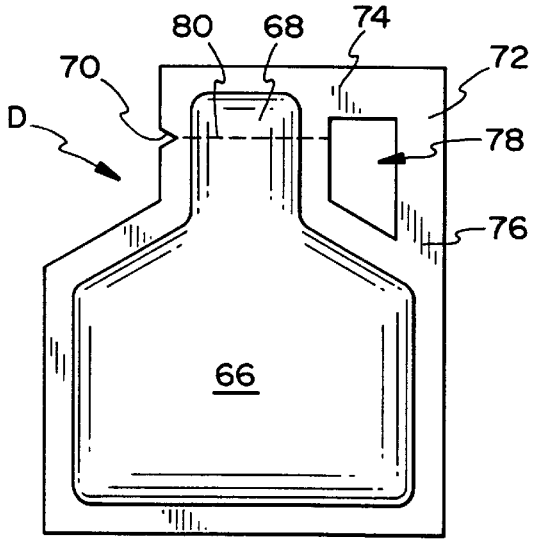
FIG. 7 is a front elevation view of another embodiment of the container and dispenser of the present invention.

Turning to FIG. 7, an alternative embodiment of the present invention is shown whereby a container D is provided having a main body portion 66, an opening region 68, a notch 70 and a connector member 72 having a first end 74 and an opposite second end 76 forming a passageway 78 extending between the connector member 56 and the perimeter edge of the main body portion 66. Dotted line 80 is provided to indicate the direction along which the opening region 68 of the container D is torn to create an opening for dispensing of the product. After opening of the container D, the opening region will remain attached to the main body portion 66 by the connector member 72.

Figure 8:
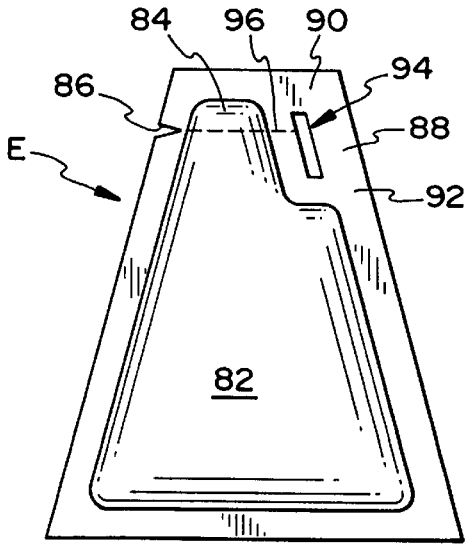
FIG. 8 is a front elevation view of another embodiment of the container and dispenser of the present invention.

FIG. 8 is directed to an alternative embodiment of the present invention whereby container and dispenser E includes a main body portion 82 having an opening region 84 located at a top end portion of the container and includes a notch 86 adjacent the frangible region identified by dotted line 96 along which an opening may be formed. A connecting member 88 is provided, the connecting member 88 having a first end 90 secured to the opening region 84 and a second end 92 secured to the main body portion 82 along a perimeter edge. An optional passageway 94 is shown extending between the main body portion and the connecting member 88. To open the container and dispenser E, an opening is made along dotted line 96 and the product is dispensed. The opening region is severed from the main body portion adjacent the dotted line 96 but remains attached due to the connecting member 88.

Figure 9:
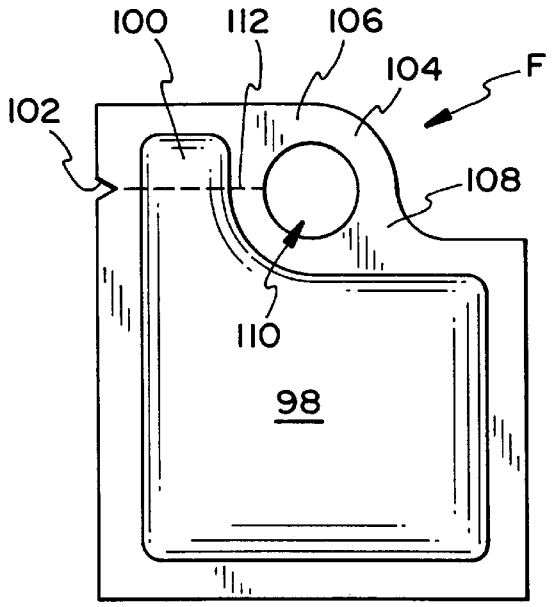
FIG. 9 is a front elevation view of another embodiment of the container and dispenser of the present invention.

FIG. 9 illustrates a further embodiment of the present invention. Container and dispenser F comprises a main body portion 98 having an opening region 100 located at an upper portion of the container. Notch 102 provides and edge for allowing the user to cause an opening to be made in the package along a line 112 extending across the opening region. Connecting member 104 includes a first end 106 attached to opening region 100 and a second end 108 attached and integral main body portion 98. A passageway 110 is shown to extend between the connecting member 104 and the main body portion 108. Dotted line 112 indicates the frangible region along which a tear can be made to cause the package to be opened and in a manner as set forth above. As is apparent, following opening, the connecting member 104 will retain a connection between the opening region and the main body portion. The embodiment of FIG. 9 also provides the advantage of allowing the package to be supported upon a display rack or the like whereby the aperture or passageway 110 is centrally disposed along the upper region of the package.

Figure 10:
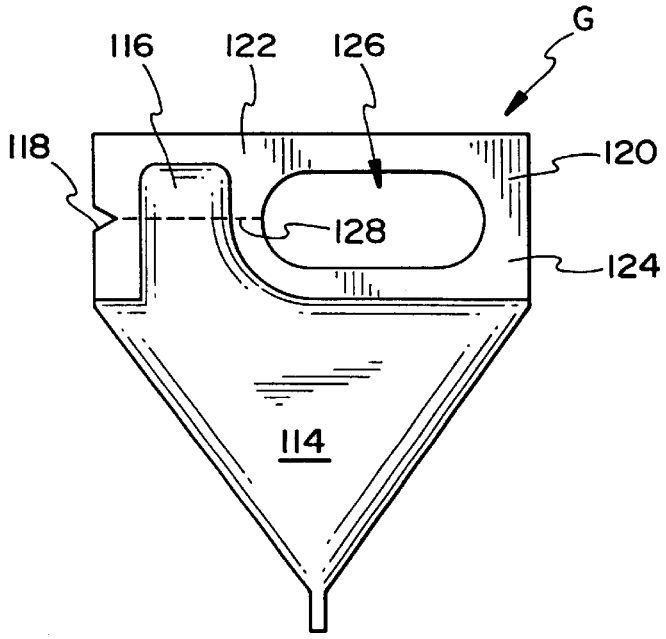
FIG. 10 is a front elevation view of another embodiment of the container and dispenser of the present invention; and, FIG. 11 is a side elevation view of the container and dispenser shown in FIG. 10.
Figure 11:
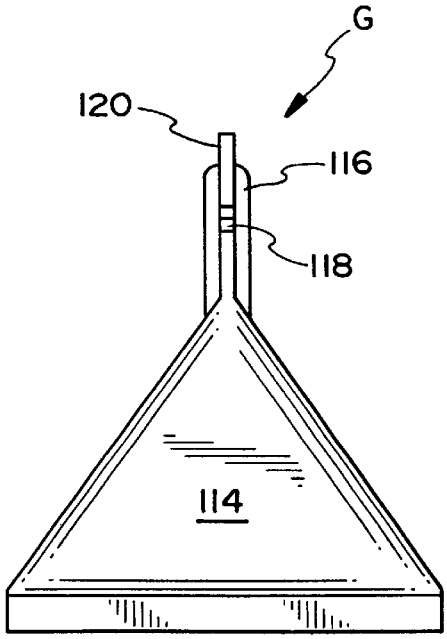

Turning to FIGS. 10 and 11 a container G is shown having a main body portion 98 and an opening region 116 at one end of the body portion. A notch 118 is provided to assist in forming an opening in package as with the embodiments noted above. The opening will extend along a frangible region or rupturable region indicated by dotted line 128. A connecting member 120 is provided having a first end 122 and a second end 124 attached to the opening region 116 and main body portion 115 respectively. A passageway 126 extends between the connecting member 120 and the main body portion 114. The package is opened by causing a tear to be formed along dotted line 128 with connector 120 maintaining the opening region in a secured relation to the main body portion 114.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

I claim:

1. A material container and dispenser comprising:

a) a body member having an interior region for containing a material to be dispensed and an exit portion in fluid communication with said interior region;

b) a dispensing spout having a longitudinal axis, said dispensing spout is positioned at said exit portion and coaxially aligned with each of said body member and said exit portion therewith;

c) a frangible portion integral with said body member and substantially perpendicular to the longitudinal axis of said dispensing spout, said frangible portion adapted to rupturably provide an opening through said body member and into said interior region, said frangible portion connects said dispensing spout to said exit portion and extends a sufficient distance therebetween whereby rupturing thereof will sever said connection; and d) a tether strap member having a first end and a second end, said tether strap member first end engaged to said body member and said tether strap member second end engaged to said dispensing spout whereby said dispensing spout remains secured to said body member following opening thereof.

2. A material container and dispenser as in claim 1 and wherein:

a) said frangible portion comprising a score line.

3. A material container and dispenser as in claim 2 and wherein:

a) said score line extends from a first edge surface of said exit portion to a second edge surface of said exit portion.

4. A material container and dispenser as in claim 1 and wherein:

a) said body member is constructed of the same material as said frangible portion.

5. A material container and dispenser as in claim 1 and wherein:

a) said tether strap extends from an edge surface of said dispensing spout to an edge surface of said body member.

6. A material container and dispenser as in claim 1 and wherein:

a) at least said frangible portion is constructed from a tearable material.

7. A material container and dispenser as in claim 1 and wherein:

a) said tether strap is integral with said body member.

8. A material container and dispenser as in claim 1 and wherein:

a) said exit portion is an elongated neck portion.

9. A material container and dispenser comprising:

a) a body member having at least a front panel and a rear panel, said panels secured therebetween about respective perimeter edges to provide a sealed interior region for containing a material to be dispensed and an exit portion in fluid communication with said interior region;

b) a dispensing spout having a longitudinal axis, said dispensing spout is positioned at said exit portion and coaxially aligned with each of said body member and said exit portion therewith;

c) a frangible portion integral with said body member and substantially perpendicular to the longitudinal axis of said dispensing spout, said frangible portion adapted to rupturably provide an opening through said body member and into said interior region, said frangible portion connects said dispensing spout to said exit portion and extends a sufficient distance therebetween whereby rupturing thereof will sever said connection; and d) a tether strap member having a first end and a second end, said tether strap member first end engaged to a first region of said body member and engaged at said second end to said dispenser spout whereby said dispenser spout will remain interconnected to said body member following opening thereof.

10. A material container and dispenser as in claim 9 and wherein:

a) said tether strap is coextensive with said perimeter edges and integral therewith.

11. A material container and dispenser as in claim 9 and wherein:

a) said body member and said frangible portion are constructed from the same material.

12. A material container and dispenser as in claim 9 and wherein:

a) said tether strap extends from a first surface of said perimeter edge to an edge surface of said dispensing spout.

13. A material container and dispenser as in claim 9 and wherein:

a) said tether strap is integral with said body member.

* * * * *